US005421968A

United States Patent [19]

Bennett et al.

[11] Patent Number: 5,421,968

[45] Date of Patent: Jun. 6, 1995

[54] CATHODIC PROTECTION SYSTEM FOR A STEEL-REINFORCED CONCRETE STRUCTURE

[75] Inventors: John E. Bennett, Painesville; Gerald R. Pohto; Thomas A. Mitchell, both of Mentor, all of Ohio

[73] Assignee: Eltech Systems Corporation, Chardon, Ohio

[21] Appl. No.: 590,623

[22] Filed: Sep. 28, 1990

Related U.S. Application Data

[63] Continuation of Ser. No. 855,549, Apr. 29, 1986, abandoned, which is a continuation-in-part of Ser. No. 731,420, May 7, 1985, abandoned.

[51] Int. Cl.[6] ..... C23F 13/00

[52] U.S. Cl. ..... 204/147; 29/6.1; 204/196; 204/290 F

[58] Field of Search ..... 204/147, 148, 196, 197, 204/290 F

[56] References Cited

U.S. PATENT DOCUMENTS

| | | | |
|---|---|---|---|
| 1,140,117 | 5/1915 | Clark | 29/6.1 |
| 2,933,410 | 4/1960 | Brightly | 427/178 |
| 3,049,497 | 8/1962 | Preiser et al. | 204/147 |
| 3,265,526 | 8/1966 | Beer | 117/50 |
| 3,278,404 | 10/1966 | Cotton et al. | 204/147 |
| 3,462,353 | 8/1969 | Every et al. | 204/147 |
| 3,632,498 | 1/1972 | Beer | 204/290 F |
| 3,671,415 | 6/1972 | King et al. | 204/284 |
| 3,711,385 | 1/1973 | Beer | 204/59 |
| 3,981,790 | 9/1976 | Olson et al. | 204/286 |
| 4,097,346 | 6/1978 | Robertson | 204/80 |
| 4,097,347 | 6/1978 | Packer | 204/109 |
| 4,255,241 | 3/1981 | Kroon et al. | 204/147 |

(List continued on next page.)

FOREIGN PATENT DOCUMENTS

| | | | |
|---|---|---|---|
| 1235088 | 4/1988 | Canada . | |
| 0147977 | 7/1985 | European Pat. Off. | C23F 13/02 |
| 57-145992 | 9/1982 | Japan | C25B 1/46 |
| 634217 | 3/1950 | United Kingdom . | |
| 885817 | 12/1961 | United Kingdom . | |
| 896912 | 5/1962 | United Kingdom . | |
| 1285417 | 8/1972 | United Kingdom . | |
| 2000808 | 1/1979 | United Kingdom | C23F 13/00 |

(List continued on next page.)

OTHER PUBLICATIONS

Castillo et al. U.S. SIR 1+544, published Nov. 1, 1988, (eff. date May 1982).

Engineering News-Record, Jun. 14, 1984, McGraw-Hill Weekly.

Reprint Engineering News-Record, Jul. 11, 1985, McGraw-Hill.

(List continued on next page.)

*Primary Examiner*—T. Tung

*Attorney, Agent, or Firm*—John J. Freer; David J. Skrabec

[57] ABSTRACT

An anode for cathodically-protected steel-reinforced concrete is embedded in an ion-conductive overlay on the concrete structure. The anode comprises at least one sheet of highly expanded valve metal mesh having a pattern of voids defined by a network of valve metal strands connected at a multiplicity of nodes. This provides a redundancy of current-carrying paths through the mesh which ensures effective current distribution throughout the mesh even in the event of possible breakage of a number of individual strands. The surface of the valve metal mesh carries an electrochemically active coating. At least one current distribution member is welded to the valve metal mesh. The entire area of the structure to be protected, excluding non-protected openings for obstacles and the like, is covered by a single piece of the mesh, or several pieces in close proximity with one another.

15 Claims, 2 Drawing Sheets

U.S. PATENT DOCUMENTS

| | | | |
|---|---|---|---|
| 4,415,411 | 11/1983 | Kanai et al. | 204/29 |
| 4,460,441 | 7/1984 | Domning | 204/73 |
| 4,473,450 | 9/1984 | Nayak et al. | 204/147 |
| 4,502,929 | 3/1985 | Stewart et al. | 204/147 |
| 4,506,485 | 3/1985 | Apostolos | 52/515 |
| 4,519,886 | 5/1985 | de Nora et al. | 204/196 |
| 4,519,888 | 5/1985 | Akazawa et al. | 204/252 |
| 4,528,084 | 7/1985 | Beer et al. | 204/290 F |

FOREIGN PATENT DOCUMENTS

| | | | |
|---|---|---|---|
| 1562720 | 3/1980 | United Kingdom . | |
| 1603843 | 12/1981 | United Kingdom . | |
| 2140456 | 11/1984 | United Kingdom | C23F 13/00 |
| 2175609A | 12/1986 | United Kingdom . | |
| 8001488 | 7/1980 | WIPO | C23F 13/00 |

OTHER PUBLICATIONS

International Search Report, International Application No. PCT/US86/00933; Patent Abstracts of Japan, vol. 5, No. 75 (C-55) (747), 19 May 1981 and JP, A, 5625975 (Mitsubishi Jukogyo K.K.) 12 Mar. 1981.

Niles Expanded Metals Catalog, p. 12, (1973) month unavailable.

"Platinized Anode in Carbonaceous Backfill—An Evaluation", T. H. Lewis, Jr., P.E., Paper No. 194, Corrosion/79 month unavailable.

Raychem Ferex TM 100 Information Sheet, Feb. 1984.

Sudberg et al, "Anodic Passivation Studies," Reprinted from Corrosion, vol. 16, No. 2, pp. 47t-54t, Feb. 1960.

CATHODIC PROTECTION SYSTEM FOR A STEEL-REINFORCED CONCRETE STRUCTURE

This is a continuation of application Ser. No. 855,549, filed Apr. 29, 1986, now abandoned, which in turn is a continuation-in-part of application Ser. No. 731,420, filed May 7, 1985.

FIELD OF THE INVENTION

This invention relates generally to cathodic protection systems for steel-reinforced concrete structures such as bridge decks, parking garage desks, piers and supporting pillars therefor.

BACKGROUND OF THE INVENTION

The problems associated with the corrosion of reinforcing steel in concrete are now well understood. Steel reinforcing has generally performed well over the years in concrete structures such as bridge decks and parking garages, since the alkaline environment of portland cement causes the surface of the steel to "passivate" such that it does not corrode. Unfortunately, a dramatic increase in the use of road salt in the early 1960's together with an increase in coastal construction resulted in a widespread deterioration problem.

This problem developed because chloride ions, whether contained in deicing salt, in sea water, or added to fresh concrete, destroy the ability of concrete to keep the surface of the steel in a passive state. It has been determined that a chloride concentration of 0.6 to 0.8 Kg per cubic meter of concrete is the critical value above which corrosion of steel in concrete can occur. The resulting corrosion products occupy 2.5 times the volume of the original steel, and this exerts tensile stresses on the surrounding concrete. When these stresses exceed the tensile strength of the concrete, cracking and delaminations develop. With continued corrosion, freezing and thawing, and traffic load, further deterioration occurs and potholes develop.

Major research and development efforts in the field of concrete quality, construction practices, surface sealers, waterproof membranes, coated reinforcing steel, speciality concretes, and corrosion inhibitors have improved the status for new deck construction. It is generally agreed that new bridge decks constructed using selected protection systems will exhibit a long life with few maintenance problems. But many concrete structures built prior to the mid 1970's are in large part salt contaminated and continue to deteriorate at an alarming rate. Cathodic protection is recognized as the only means of stopping corrosion of steel in concrete without complete removal of the salt contaminated concrete.

Cathodic protection reduces or eliminates corrosion of a metal by making it a cathode by means of an impressed DC current or by attachment to a sacrificial anode. In this way external energy is supplied to the steel surface forcing it to function as a current receiving cathode and preventing the formation of ferrous ions. Cathodic protection was first applied to a reinforced concrete deck in June 1973. Since that time, understanding and techniques have improved, but the impressed current anodes used to distribute current to the reinforcing steel continue to be a major limitation. The anode should have the following properties:

1. Ability to withstand traffic loads and environmental conditions.

2. Design lifetime equal to or greater than the wearing surface life.

3. Sufficient surface area such that premature deterioration of the surrounding concrete does not occur, and that a good distribution of current is provided to the reinforcing steel.

4. Economically justifiable to install and maintain.

Historically, three different types of anodes have been used for cathodic protection of steel in concrete bridge decks: conductive overlays, slotted non-overlay, and distributed anodes with non-conductive overlay.

The conductive overlay was the first anode to be used and is still regarded as a useful system. In this case the anode typically consists of a mixture of asphalt, metallurgical coke breeze, and aggregate in conjunction with high silicon cast iron serving as the current contact. This system provides very uniform current distribution over the deck surface, and because the anode surface area is high, no evidence of acid or other chemical attack from anodic reaction products has been found on the underlying portland cement. The coke-asphalt overlay has exhibited structural degradation in a number of instances, however, and the time to replacement is limited to a few years. Also, freeze-thaw deterioration of improperly air-entrained concrete beneath the overlay has limited its use to decks with proper air-void systems.

Slotted non-overlay anodes were developed to extend anode life and applicability, and to realize a system which would not increase the dead load and height of the bridge deck. In this system parallel slots are first cut into the deck approximately 30–45 cm. apart. The slots are filled with a "conductive grout" mixture of carbon and organic resin which serves as the anode surface. Because the conductive grout has a limited conductivity, current is distributed to the anode by a system of platinized metal and carbon strand conductors. This anode exhibited adequate strength and freeze-thaw durability, but because its surface area is small, the adjacent concrete often experiences attack from the acid and gases which are a product of the anodic reaction. Also, distribution of current to the reinforcing steel is not ideal since the slots are widely separated. Failure was also experienced due to cracking or some other discontinuity since there is not a redundancy of current connections. Furthermore, this system is labor intensive and difficult to install.

Distributed anodes with ionically conductive overlays are similar to slotted systems, but are often easier to install. In one modification the conductive polymer grout anode is placed directly on top of the existing deck surface, together with platinized metal wire and carbon strand current conductors, and the anode is overlaid with latex-modified or conventional concrete. Rigid non-conductive overlays are often favored because they extend the deck life, retard additional salt penetration, minimize freeze-thaw damage to underlying concrete, and provide a new skid resistant riding surface. This system still experiences the same disadvantages as the slotted system regarding current distribution, acid or gas attack, and lack of redundancy.

An alternative anode for use with rigid ion-conductive overlays utilizes a flexible polymeric anode material which does not require a conductive backfill. It is produced as a continuous cable and woven into a large mesh, placed on the deck and covered with a conventional rigid overlay. This system is less time consuming to install, but still has the disadvantages of current distribution, acid or gas attack, and lack of redundancy. Such polymer anodes have been described in U.S. Pat. Nos. 4,473,450 and 4,502,929. As commercially offered, these polymer anodes are woven into a mesh with voids measuring about 20 cm. by 40 cm. Any breakage of the cable at a given point will thus impair the cathodic protection effect over a considerable area. Also the thickness of the cable (about 8 mm) is a limitation where only thin overlays are desirable.

A fourth type of system has more recently evolved for use on substructures in which the anode material is painted or sprayed directly on the concrete surface. For example, carbon loaded paints and mastics can be applied to the concrete. This provides a large anode area and ideal current distribution to the reinforcing steel. Additional platinized wire or carbon strand current connectors are needed, however, since the resistivity is high, and the anode material often peels off resulting in a short lifetime.

For example, published UK Patent Application 2 140 456A describes a conductive overlay system in which a conductive paint is applied to the surface of concrete to form an anode film. Primary anodes of platinized titanium or niobium are spaced apart each 10–50 meters for the supply of current to the anode film and thus serve essentially as current lead-ins.

An anode of flame-sprayed zinc has also been used (see for example U.S. Pat. No. 4 506 485). Originally it was thought that zinc would function as a natural galvanic anode therefore eliminating the requirement of DC power supply. It has since been established that the fixed natural voltage of zinc is too low to throw the current for sufficient distance through the concrete, however, and a power supply and current distribution system are still required. This problem coupled with the problem generated by the expansive corrosion products of zinc, have lead to minimal use of sacrificial anode systems on bridges.

With the exception of the system using zinc anodes, every system for cathodic protection of reinforcing steel in concrete has to date used carbon as the electrochemically active-anode surface. Carbon was probably first used because of its extensive use as an anode in traditional cathodic protection. It was also used because cathodic protection in concrete requires-very low current densities, which infers a very large anode surface area. This implies that the anode must be low cost, and carbon is relatively inexpensive.

Since pure carbon is not available in a structure which would be suitable for use in concrete, carbon was used as a conductive filler in organic resins, thermoplastic polymers, paints, and mastics. This technique put carbon into a physical form which could be used in conjunction with concrete, but other disadvantages of carbon remain. Carbon has a low electrical conductivity relative to metals, requiring an elaborate system of current conductors. Also, carbon is thermodynamically unstable as an anode, reacting to form carbon dioxide $CO_2$, carbonic acid $H_2CO_3$, and carbonates $HCO_3^-$ and $CO_3^{2-}$, reaction products which are potentially harmful to portland cement. These reactions are known to be kinetically slow, but the effect of such reactions on anode lifetime may still be significant since, when in contact with a solid electrolyte such as concrete, even a small amount of oxidation will disrupt the anode-electrolyte interface causing a loss of electrical contact. Finally, carbon is a poor anode from the standpoint of electrochemical activity. Single electrode potentials at carbon anodes will be relatively high when operated in chloride contaminated concrete resulting in the release of chlorine gas $Cl_2$, and hypochlorite $ClO^-$. These reaction products will probably not be harmful to concrete, but they are strong oxidizers which react with the organic binders used, again causing concern over anode lifetime.

In summary, none of the anodes used to date exhibit all of the properties desirable for cathodic protection of steel in concrete. Although many appear to be economically justifiable, many lack sufficient area to prevent. deterioration of the concrete adjacent to the anode, many do not result in an ideal current distribution, and all present serious questions about anode lifetime. Zinc anodes are oxidized to zinc oxide which disrupts the anode-concrete interface. All anodes containing carbon operate at a high single electrode potential and generate chlorine, acid, and carbon dioxide, products which are likely to cause eventual damage to the adjacent concrete and to the organic matrix used to bind the carbon.

Electrocatalytically active anodes with valve metal substrates are known and have been successfully used in a number of applications, in particular chlorine, chlorate and hypochlorite production and as oxygen-evolving anodes in metal winning processes. Generally, the cost of such electrodes makes them particularly advantageous in "high" current density applications, e.g., 6–10 $KA/m^2$ for chlorine production in a mercury cell or 3–5 $KA/m^2$ in a membrane cell. Such electrodes have also been proposed for cathodic protection, but have found only limited applications in this area. In one typical cathodic protection arrangement, a wire of platinized copper-cored titanium is used to protect a metal structure. PCT Application W080/01488 described such an arrangement in which the platinized wire is wound around an insulating rope. UK Patent Application 2 000 808A proposed replacing the conventional platinized wires or rods with a channel-sectioned valve metal strip having anodically active material on the U or V-shaped spine.

Platinized valve metal meshes have also been proposed for cathodic protection of certain structures. See for example "Corrosion/79" paper number 194 which describes use of a rigid titanium expanded mesh measuring less that 0.05 $m^2$ and coated with a layer of 1–15 micron of platinum capable of carrying a current density of 2.15 $A/dm^2$. This was used as a discrete anode in groundbeds containing carbonaceous backfill. Rigid anode meshes of this type having an overall area up to 0.5 $m^2$ have been offered as discrete anodes for the protection of remote structures.

U.S. Pat. No. 4,519,886 describes a linear type of anode structure for the cathodic protection of metal structures comprising a plurality of cylindrical anode segments spaced along and connected to a power supply cable. The cylindrical anode segments may be made of expanded titanium bent to shape and coated with a mixed metal oxide coating.

Obviously, none of the known coated valve metal electrodes including those proposed for other cathodic protection applications would be suitable for the cathodic protection of concrete structures. In particular, the anode designs are unsuitable for installation in this application and the cost of protecting an installation would be prohibitive.

SUMMARY OF THE INVENTION

The main aspect of the invention as set out in the accompanying claims is a novel cathodically-protected steel-reinforced concrete structure comprising an impressed-current anode embedded in an ion-conductive overlay on the concrete structure, wherein the anode comprises at least one sheet of valve metal mesh having a pattern of voids defined by a network of valve metal strands. The strands of each mesh are connected at a multiplicity of nodes providing a redundancy of current-carrying paths through the mesh which ensures effective current distribution throughout the mesh even in the event of possible breakage of a number of individual strands. The surface of the valve metal mesh carries an electrochemically active coating. Furthermore, the anode comprises at least one current distribution member for supplying current to the valve metal mesh. The sheet or sheets of the valve metal mesh extend essentially continuously over an entire area of the structure to be protected with no discontinuity (i.e. between two adjacent sheets of the mesh) which is larger, in two mutually perpendicular directions, than twice the largest dimension of the voids of the mesh. In other words, the entire area Of the structure to be protected, excluding non-protected openings for obstacles and the like, is covered by a single piece of the mesh, or several pieces in close proximity with one another.

Preferably, the mesh consists of a sheet of expanded valve metal, typically titanium and with a maximum thickness of 0.125 cm, which has been expanded by a factor of at least 10 times and preferably 15 to 30 times. This provides a substantially diamond shaped pattern of voids and a continuous network of valve metal strands interconnected by between about 500 to 2000 nodes per square meter of the mesh. Such a mesh is highly flexible and can be made in sheets of large dimensions which are conveniently coiled about an axis parallel to the long way of the diamond pattern. Further details of the coiled, highly expanded valve metal mesh, its method of production and its method of installation are given in concurrently filed U.S. applications, Ser. No. 855,552, filed Apr. 29, 1986, now abandoned, Ser. No. 855,551, now U.S. Pat. No. 4,708,888, and Ser. No. 855,550, now U.S. Pat. No. 4,900,410, the contents of which are incorporated herein by way of reference.

As an alternative to using a sheet of highly expanded valve metal mesh, it is possible to employ a valve metal mesh constructed of valve metal ribbons connected together, e.g., by welding typically in a hexagonal or honeycomb pattern. Such a composite mesh should meet up to the same requirements concerning its dimensions and configuration as set out above for the expanded meshes.

Each current distribution member is preferably a strip of valve metal coated with the same electrochemically active coating as the mesh and is metallurgically bonded to the mesh. In many installations such as parking garage decks and bridge decks, the current distributor strips may advantageously be bonded to the mesh with a spacing of between about 10 and 50 meters, calculated to provide an adequate current density to the mesh. In such installations, it is also cost saving and convenient to have a common current distributor strip bonded to and extending across at least two sheets of the valve metal mesh, for example across two elongated sheets of the mesh which have been rolled side-by-side from two rolls.

Most advantageously, the current distributor strips are spot welded to the nodes of the mesh. This spot welding can be achieved on the facing surfaces of the mesh and strip which are coated with an adequately thin electrocatalytic coating.

Points of the mesh may be fixed to the concrete structure by fasteners inserted in drill holes in the structure. Alternative means of fixing the mesh to the structure prior to applying the ion-conductive overlay are also possible, including the use of adhesive. This is more fully described in concurrently filed U.S. application Ser. No. 855,550, now U.S. Pat. No. 9,900,410.

At least two sheets of the mesh may overlap with one another, either overlapping edges of two side-by-side long sheets which may assist in reducing the number of anchorage points during assembly, or overlapping end sections where the overlap may be designed to provide electrical connection. However, providing each sheet is associated with a current distribution member, the sheets do not have to be in touching relationship but may be spaced apart conveniently up to a spacing corresponding to about the maximum size (LWD) of the usually diamond shaped apertures of the mesh.

Also, at least one sheet of the mesh may have a cutout section bounding an obstacle on the structure, such as a drain in a parking garage deck or an aperture through the deck for connection of the current distributors to a current supply.

It is also possible, but usually not preferred, for adjacent sheets of the mesh to be welded together directly or by means of a connecting strip.

For most structures, the ion-conductive layer comprises about 3–6 cm thick of portland current or polymer-modified concrete applied in a single pass e.g. by pouring. Usually, the overlay is preceded by the application of a bonding grout, i.e., a separate cement-based grout without large aggregate which is mixed-up, poured on the surface and brushed over the mesh immediately before overlay.

In cases where a thin overlay is necessary for structural or other reasons, the ion-conductive overlay can be applied in several thin layers by spraying. The mesh may be substantially embedded by the first layer: for example more than 90% of the mesh may be covered. At this point, it is possible to identify protruding sections of the mesh and flatten and/or trim these before applying the next layer or layers. An advantage of the invention, which typically employs a mesh up to 0.125 cm thick is that it can be effectively used in an overlay as thin as 0.6 cm. This cannot be achieved effectively with any other known system.

The cathodically-protected structure according to the invention preferably also has a current supply connected to the current distributors and arranged to supply a cathodic protection current at a current density of up to 100 $mA/m^2$ of the surface area of the strands of the mesh, either a continuous current or intermittent.

When the structure is a concrete deck covered by a series of side-by-side elongate sheets of the mesh with a common current distributor strip extending across the sheets, the current distributor strip may conveniently extend through an aperture in the deck to a current supply disposed underneath the deck at a location where it is readily accessible for servicing etc.

The protected structure may be an e.g. cylindrical pillar which is encased with the mesh and ion-conductive overlay. The current distributor may in this case be a strip disposed vertically on the pillar and the mesh is one or more sheets cut to size so that it is wrapped around the pillar with little or no overlap.

The invention also pertains to a method of cathodically protecting the aforementioned structure by supplying a continuous or intermittent current to the valve metal mesh at a current density, usually below 100 $mA/m^2$ of the strand surface area, which is effective for oxygen generation on the surfaces of the coated valve metal mesh. This current density can be established by taking periodic measurements of the corrosion potential of the steel using suitably distributed reference electrodes in the proximity of the reinforcing steel, and setting the operative current density to maintain the steel at a desired potential for preventing corrosion.

The reference electrodes are very advantageously also constructed of a valve metal mesh with an electrocatalytic coating. However, these reference electrodes will be relatively small, for example about 1–3 cm wide by 2–10 cm long, and are preferably made of a conventional valve metal mesh which is quite rigid. These reference electrodes are placed horizontally in recesses in the concrete structure at the same level as the steel reinforcement and spaced horizontally by about 2–3 cm from the steel; in this location they are favorably placed in the electric field and are exposed to an electrolyte composition representative of the corrosive environment around the steel. In most structures the steel is located about 3 to 10 cm below the concrete surface. Typically one or two reference electrodes are arranged for each approximately 500 $m^2$ zone of the anode mesh. The electrocatalytic coating on the reference electrodes may be the same as that on the anode mesh, or it can have a special formulation selected to produce oxygen evolution at a precise reference potential. These coated valve metal reference electrodes have considerable advantages over the heretofore used reference electrodes. For instance, the potential of this reference electrode is not dependent on the concentration of an ionic species which may vary greatly in the electrolyte, as is the case with silver/silver chloride and copper/copper sulfate reference electrodes. Nor is the potential subject to change due to a reaction of the electrode surface, as is the case with a molybdenum/molybdenum oxide reference electrode.

The described cathodic protection system according to the invention has the following advantages:

- use of a non-corroding valve metal (titanium). The system involve no carbon or corrodable metals such as copper.
- only oxygen is evolved by the coated anode mesh in use. Active chlorine, which may itself have long term deleterious effects, is not generated as it is with other types of anode.
- metallurgical bonds (welds) are used for all electrical connections within the ion-conductive overlay. There are no mechanical connections and no copper conductors within the concrete.
- the fine mesh structure of the anode insures uniform current distribution.
- the anode mesh has thousands of interconnected strands serving as multiple current paths. These assure that the system will continue to operate satisfactorily even if several strands are broken due to stresses in the structure or future coring.
- where the mesh is connected to the current distributor, there can be several welds for each sheet of mesh even though only one or two would suffice.
- the low cost of the highly expanded mesh, the low catalyst loading and the ease of installation make the system very cost effective.

Also, electrocatalytic coating used in the present invention is such that the anode operates at a very low single electrode potential, and may have a life expectancy of greater than 20 years in a cathodic protection application. Unlike other anodes used heretofore for the cathodic protection of steel in concrete, it is completely stable dimensionally and produces no carbon dioxide or chlorine from chloride contaminated concrete. It furthermore has sufficient surface area such that the acid generated from the anodic reaction will not be detrimental to the surrounding concrete.

DESCRIPTION OF THE PREFERRED EMBODIMENTS

Figure 1:
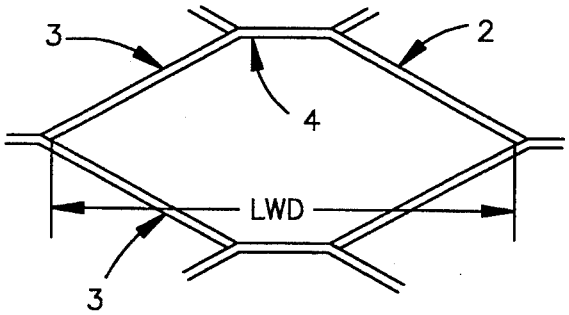
FIG. 1 shows a diamond-shaped unit of a greatly expanded valve metal mesh employed in this invention.

The Highly Expanded Valve Metal Mesh Anode

The metals of the valve metal mesh will most always be any of titanium, tantalum, zirconium and niobium. As well as the elemental metals themselves, the suitable metals of the mesh can include alloys of these metals with themselves and other metals as well as their intermetallic mixtures. Of particular interest for its ruggedness, corrosion resistance and availability is titanium. Where the mesh will be expanded from a metal sheet, the useful metal of the sheet will most always be an annealell metal. As representative of such serviceable annealed metals is Grade I titanium, an annealed titanium of low embrittlement. Such feature of low embrittlement is necessary where the mesh is to be prepared by expansion of a metal sheet, since such sheet should have an elongation of greater than 20 percent. This would be an elongation as determined at normal temperature, e.g., 20° C., and is the percentage elongation as determined in a two-inch (5 cm.) sheet of greater than 0.025 inch (0.0635 cm.) thickness. Metals for expansion having an elongation of less than 20 percent will be too brittle to insure suitable expansion to useful mesh without deleterious strand breakage.

Advantageously for enhanced freedom from strand breakage, the metal used in expansion will have an elongation of at least about 24 percent and will virtually always have an elongation of not greater than about 40 percent. Thus metals such as aluminum are neither contemplated, nor are they useful, for the mesh in the present invention, aluminum being particularly unsuitable because of its lack of corrosion resistance. Also with regard to the useful metals, annealing may be critical as for example with the metal tantalum where an annealed sheet can be expected to have an elongation on the order of 37 to 40 percent, which metal in unannealed form may be completely useless for preparing the metal mesh by having an elongation on the order of only 3 to 5 percent. Moreover, alloying may add to the embrittlement of an elemental metal and thus suitable alloys may have to be carefully selected. For example, a titanium-palladium alloy, commercially available as Grade 7 alloy and containing on the order of 0.2 weight percent palladium, will have an elongation at normal temperature of above about 20 percent and is expensive but could be serviceable, particularly in annealed form. Moreover, where alloys are contemplated, the expected corrosion resistance of a particular alloy that might be selected may also be a consideration. For example, in Grade I titanium, such is usually available containing 0.2 weight percent iron. However, for superior corrosion resistance, Grade I titanium is also available containing less than about 0.05 weight percent iron. Generally, this metal of lower iron content will be preferable for many applications owing to its enhanced corrosion resistance.

The metal mesh may then be prepared directly from the selected metal. For best ruggedness in extended metal mesh life, it is preferred that the mesh be expanded from a sheet or coil of the valve metal. It is however contemplated that alternative meshes to expanded metal meshes may be serviceable. For such alternatives, thin metal ribbons can be corrugated and individual cells, such as honeycomb shaped cells can be resistance welded together from the ribbons. Slitters or corrugating apparatus could be useful in preparing the metal ribbons and automatic resistance welding could be utilized to prepare the large void fraction mesh. By the preferred expansion technique, a mesh of interconnected metal strands can directly result. Typically where care has been chosen in selecting a metal of appropriate elongation, a highly serviceable mesh will be prepared using such expansion technique with no broken strands being present. Moreover with the highly serviceable annealed valve metals having desirable ruggedness coupled with the requisite elongation characteristic, some stretching of the expanded mesh can be accommodated during installation of the mesh. This can be of particular assistance where uneven substrate surface or shape will be most readily protected by applying a mesh with such stretching ability. Generally a stretching ability of up to about 10 percent can be accommodated from a roll of Grade I titanium mesh having characteristics such as discussed hereinbelow in the example. Moreover the mesh obtained can be expected to be bendable in the general plane of the mesh about a bending radius in the range of from 5 to 25 times the width of the mesh.

Where the mesh is expanded from the metal sheet, the interconnected metal strands will have a thickness dimension corresponding to the thickness of the initial planar sheet or coil. Usually this thickness will be within the range of from about 0.05 centimeter to about 0.125 centimeter. Use of a sheet having a thickness of less than about 0.05 centimeter, in an expansion operation, can not only lead to a deleterious number of broken strands, but also can produce a too flexible material that is difficult to handle. For economy, sheets of greater than about 0.125 centimeter are avoided. As a result of the expansion operation, the strands will interconnect at nodes providing a double strand thickness of the nodes. Thus the node thickness will be within the range of from about 0.1 centimeter to about 0.25 centimeter. Moreover, after expansion the nodes for the special mesh will be completely, to virtually completely, non-angulated. By that it is meant that the plane of the nodes through their thickness will be completely, to virtually completely, vertical in reference to the horizontal plane of an uncoiled roll of the mesh.

In considering the preferred valve metal titanium, the weight of the mesh will usually be within the range of from about 0.05 kilogram per square meter to about 0.5 kilogram per square meter of the mesh. Although this range is based upon the exemplary metal titanium, such can nevertheless serve as a useful range for the valve metals generally. Titanium is the valve metal of lowest specific gravity. On this basis, the range can be calculated for a differing valve metal based upon its specific gravity relationship with titanium. Referring again to titanium, a weight of less than about 0.05 kilogram per square meter of mesh will be insufficient for proper current distribution in enhanced cathodic protection. On the other hand, a weight of greater than about 0.5 kilogram per square meter will most always be uneconomical for the intended service of the mesh.

The mesh can then be produced by expanding a sheet or coil of metal of appropriate thickness by an expansion factor of at least 10 times, and preferably at least 15 times. Useful mesh can also be prepared where a metal sheet has been expanded by a factor up to 30 times its original area. Even for an annealed valve metal of elongation greater than 20 percent, an expansion factor of greater than 30:1 may lead to the preparation of a mesh exhibiting strand breakage. On the other hand, an expansion factor of less than about 10:1 may leave additional metal without augmenting cathodic protection. Further in this regard, the resulting expanded mesh should have an at least 80 percent void fraction for efficiency and economy of cathodic protection. Most preferably, the expanded metal mesh will have a void fraction of at least about 90 percent, and may be as great as 92 to 96 percent or more, while still supplying sufficient metal and economical current distribution. With such void fraction, the metal strands can be connected at a multiplicity of nodes providing a redundancy of current-carrying paths through the mesh which insures effective current distribution throughout the mesh even in the event of possible breakage of a number of individual strands, e.g., any breakage which might occur during installation or use. Within the expansion factor range as discussed hereinbefore, such suitable redundancy for the metal strands will be provided in a network of strands most always interconnected by from about 500 to about 2000 nodes per square meter of the mesh. Greater than about 2000 nodes per square meter of the mesh is uneconomical. On the other hand, less than about 500 of the interconnecting nodes per square meter of the mesh may provide for insufficient redundancy in the mesh.

Within the above-discussed weight range for the mesh, and referring to a sheet thickness of between about 0.05–0.125 centimeter, it can be expected that strands within such thickness range will have width dimensions of from about 0.05 centimeter to about 0.20 centimeter. For the special application to cathodic protection in concrete, it is expected that the total surface area of interconnected metal, i.e., including the total surface area of strands plus noaes, will provide between about 10 percent up to about 50 percent of the area covered by the metal mesh. Since this surface area is the total area, as for example contributed by all four faces of a strand of square cross-section, it will be appreciated that even at a 90 percent void fraction such mesh can have a much greater than 10 percent mesh surface area. This area will usually be referred to herein as the "surface area of the metal" or the "metal surface area". If the total surface area of the metal is less than about 10 percent, the resulting mesh can be sufficiently fragile to lead to deleterious strand breakage. On the other hand, greater than about 50 percent surface area of metal will supply additional metal without a commensurate enhancement in protection.

After expansion the resulting mesh can be readily rolled into coiled configuration, such as for storage or transport or further operation. With the representative valve metal titanium, rolls having a hollow inner diameter of greater than 20 centimeters and an outer diameter of up to 150 centimeters, preferably 100 centimeters, can be prepared. These rolls can be suitably coiled from the mesh when such is prepared in lengths within the range of from about 40 to about 200, and preferably up to 100, meters. For the metal titanium, such rolls will have weight on the order of about 10–50 kilograms, but usually below 30 kilograms to be serviceable for handling, especially following coating, and particularly handling in the field during installation for cathodic protection.

The coated metal mesh can serve for cathodic protection of steel reinforced concrete. It may also be similarly serviceable in direct earth burial cathodic protection. Generally, it may be utilized in any operation wherein the electrocatalytic coating on a valve metal substrate will be useful and wherein current density operating conditions up to 10 amps per square meter of metal surface area are contemplated. It is advantageous if the coated metal mesh is in coiled form, as for rolling out of an electrode to be incorporated in a cathodic protection system as discussed herein which system is preferably installed as discussed in the U.S. patent application Ser. No. 855,550, now U.S. Pat. No. 4,900,410. The teachings of these foregoing applications is herein incorporated by reference.

In such greatly expanded valve metal mesh it is most typical that the gap patterns in the mesh will be formed as diamond-shaped apertures. Such "diamond-pattern" will feature apertures having a long way of design (LWD) from about 4, and preferably from about 6, centimeters up to about 9 centimeters, although a longer LWD is contemplated, and a short way of design (SWD) of from about 2, and preferably from about 2.5, up to about 4 centimeters. In the preferred application of cathodic protection in concrete, diamond dimensions having an LWD exceeding about 9 centimeters may lead to undue strand breakage and undesirable voltage loss. An SWD of less than about 2 centimeters, or an LWD of less than about 4 centimeters, in the preferred application, can be uneconomical in supplying an unneeded amount of metal for desirable cathodic protection.

Referring now more particularly to FIG. 1 an individual diamond shape, from a sheet containing many such shapes is shown generally at 2. The shape is formed from strands 3 joining at connections (nodes) 4. As shown in the Figure, the strands 3 and connections 4 form a diamond aperture having a long way of design in a horizontal direction. The short way of design is in the opposite, vertical direction. When referring to the surface area of the interconnected metal strands 3, e.g., where such surface area will supply not less than about 10 percent of the overall measured area of the expanded metal as discussed hereinabove, such surface area is the total area around a strand 3 and the connections 4. For example, in a strand 3 of square cross-section, the surface area of the strand 3 will be four times the depicted, one-side-only, area as seen in the Figure. Thus in FIG. 1, although the strands 3 and their connections 4 appear thin, they may readily contribute 20 to 30 percent surface area to the overall measured area of the expanded metal. In the FIG. 1, the "area of the mesh", e.g., the square meters of the mesh, as such terms are used herein, is the area encompassed within an imaginary line drawn around the periphery of the Figure.

In FIG. 1, the area within the diamond, i.e., within the strands 3 and connections 4, may be referred to herein as the "diamond aperture". It is the area having the LWD and SWD dimensions. For convenience, it may also be referred to herein as the "void", or referred to herein as the "void fraction", when based upon such area plus the area of the metal around the void. As noted in FIG. 1 and as discussed hereinbefore, the metal mesh as used herein has extremely great void fraction. Although the shape depicted in the figure is diamond-shaped, it is to be understood that many other shapes can be serviceable to achieve the extremely great void fraction, e.g., scallop-shaped or hexagonal.

Figure 2:
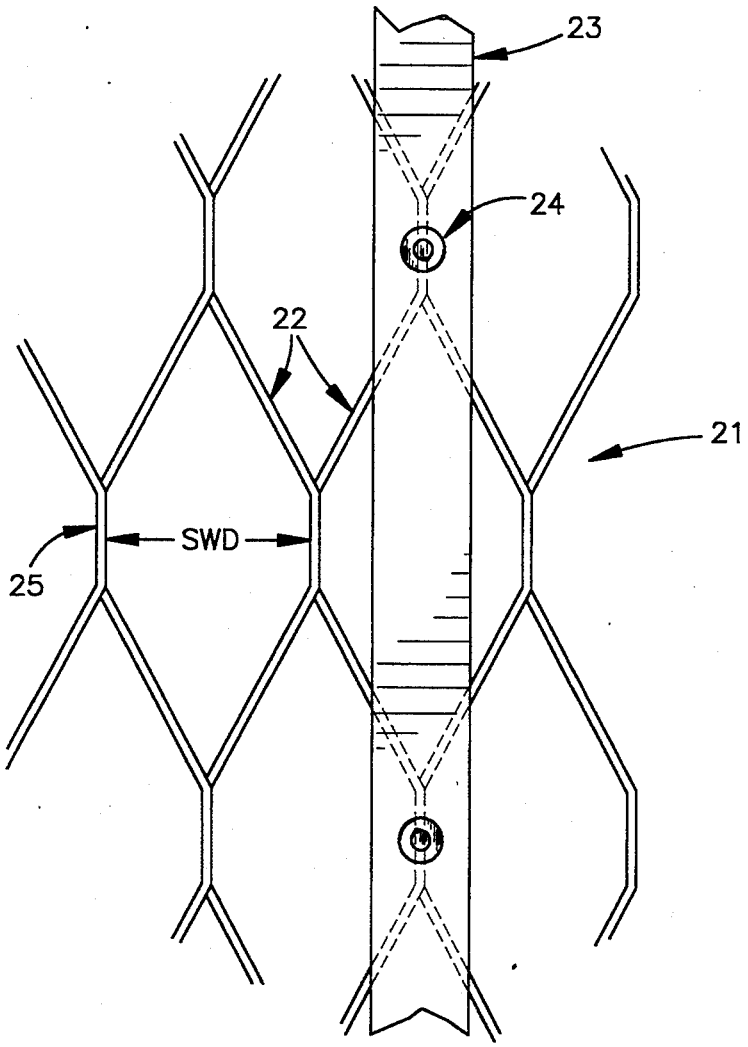
FIG. 2 is a section of the valve metal mesh having a current distributor welded along the LWD and welded to mesh nodes.

Referring now to FIG. 2, several individual diamonds 21 are formed of individual strands 22 and their interconnections 25 thereby providing diamond-shaped apertures. A row of the diamonds 21 is bonded to a metal strip 23 at the intersections 25 of strands 22 with the metal strip 23 running along the LWD of the diamond pattern. The assembly is brought together by spotwelds 24, with each individual strand connection (node) 25 located under the strip 23 being welded by a spotweld 24. Generally the welding employed will be electrical resistance welding and this will most always simply be spot welding, for economy, although other, similar welding technique, e.g., roller welding, is contemplated. This provides a firm interconnection for good electroconductivity between the strip 23 and the strands 22. As can be appreciated by reference particularly to FIG. 2, the strands 22 and connections 25 can form a substantially planar configuration. As such term is used herein it is meant that particularly larger dimensional sheets of the mesh may be generally in coiled or rolled condition, as for storage or handling, but are capable of being unrolled into a "substantially planar" condition or configuration, i.e., substantially flat form, for use. Moreover, the connections 25 will have double strand thickness, whereby even when rolled flat, the substantially planar or flat configuration may nevertheless have ridged connections.

Figure 3:
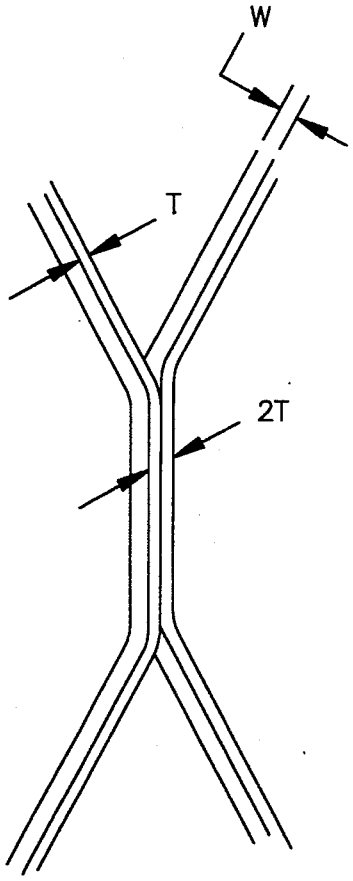
FIG. 3 is an enlarged view of a mesh node showing the node double.

Referring then to the enlarged view in FIG. 3, it can be seen that the nodes have double strand thickness (2T). Thus, the individual strands have a lateral depth or thickness (T) not to exceed about 0.125 centimeter, as discussed hereinabove, and a facing width (W) which may be up to about 0.20 centimeter.

The expanded metal mesh can be usefully coated. It is to be understood that the mesh may also be coated before it is in mesh form, or combinations might be useful. Whether coated before or after being in mesh form, the substrate can be particularly useful for bearing a catalytic active material, thereby forming a catalytic structure. As an aspect of this use, the mesh substrate can have a catalyst coating, resulting in an anode structure. Usually before any of this, the valve metal mesh will be subjected to a cleaning operation, e.g., a degreasing operation, which can include cleaning plus etching, as is well known in the art of preparing a valve metal to receive an electrochemically active coating. It is also well known that a valve metal, which may also be referred to herein as a "film-forming" metal, will not function as an anode without an electrochemically active coating which prevents passivation of the valve metal surface. This electrochemically active coating may be provided from platinum or other platinum group metal, or it may be any of a number of active oxide coatings such as the platinum group metal oxides, magnetite, ferrite, cobalt spinel, or mixed metal oxide coatings, which have been developed for use as anode coatings in the industrial electrochemical industry. It is particularly preferred for extended life protection of concrete structures that the anode coating be a mixed metal oxide, which can be a solid solution of a film-forming metal oxide and a platinum group metal oxide.

For this extended protection application, the coating should be present in an amount of from about 0.05 to about 0.5 gram of platinum group metal per square meter of expanded valve metal mesh. Less than about 0.05 gram of platinum group metal will provide insufficient electrochemically active coating to serve for preventing passivation of the valve metal substrate over extended time, or to economically function at a sufficiently low single electrode potential to promote selectivity of the anodic reaction. On the other hand, the presence of greater than about 0.5 gram of platinum group metal per square meter of the expanded valve metal mesh can contribute an expense without commensurate improvement anode lifetime. In this particular embodiment of the invention, the mixed metal oxide coating is highly catalytic for the oxygen evolution reaction, and in a chloride contaminated concrete environment, will evolve no chlorine or hypochlorite. The platinum group metal or mixed metal oxides for the coating are such as have been generally been described in one or more of U.S. Pat. Nos. 3,265,526, 3,632,498, 3,711,385 and 4,528,084. More particularly, such platinum group metals include platinum, palladium, rhodium, iridium and ruthenium or alloys of themselves and with other metals. Mixed metal oxides include at least one of the oxides of these platinum group metals in combination with at least one oxide of a valve metal or another non-precious metal. It is preferred for economy that the coating be such as have been disclosed in the U.S. Pat. No. 4,528,084.

In such concrete corrosion retarding application, the metal mesh will be connected to a current distribution member, e.g., the metal strip 23 of FIG. 2. Such member will most always be a valve metal and preferably is the same metal alloy or intermetallic mixture as the metal most predominantly found in the expanded valve metal mesh. This current distribution member must be firmly affixed to the metal mesh. Such a manner of firmly fixing the member to the mesh can be by welding as has been discussed hereinabove. Moreover, the welding can proceed through the coating. Thus, a coated strip can be laid on a coated mesh, with coated faces in contact, and yet the welding can readily proceed. The strip can be welded to the mesh at every node and thereby provide uniform distribution of current thereto. Such a member positioned along a piece of mesh about every 30 meters will usually be sufficient to serve as a current distributor for such piece.

In the application of the cathodic protection for concrete, it is important that the embedded portion of the current distribution member be also coated, such as with the same electrochemically active coating of the mesh. Like considerations for the coating weight, such as for the mesh, are also important for the current distributor member. The member may be attached to the mesh before or after the member is coated. Such current distributor member can then connect outside of the concrete environment to a current conductor, which current conductor being external to the concrete need not be so coated. For example in the case of a concrete bridge deck, the current distribution member may be a bar extending through a hole to the underside of the deck surface where a current conductor is located. In this way all mechanical current connections are made external to the finished concrete structure, and are thereby readily available for access and service if necessary. Connections to the current distribution bar external to the concrete may be of conventional mechanical means such as a bolted spade-lug connector.

Meshes produced according to the following specifications were used in the example of the method of installation described below.

| Anode Mesh Specifications | |
|---|---|
| **Type 1 Mesh** | |
| Composition | Titanium Grade 1 |
| Width of Roll | 45 inches (112.5 cm) |
| Length | 250 to 500 ft. (75 to 150 m) |
| Weight | 26 lbs./1000 ft.$^2$ (11.7 kg/100 m$^2$ |
| Diamond Dimension | 3" LWD × 1⅓" SWD (7.6 cm LWD × 3.3 cm SWD) |
| Resistance Lengthwise (45 inch/112.5 cm.wide) | .026 ohm/ft. (0.086 ohm/m) |
| Resistance Widthwise with Current Distributor | .007 ohm/ft. (0.02 ohm/m) |
| Bending Radius | 3/32 inches (0.24 cm) |
| Bending Radius in Mesh Plane | 50 ft. (15 m) |
| **Type 2 Mesh** | |
| Composition | Titanium Grade 1 |
| Width of Roll | 4 ft. (122 cm) |
| Length | 250 to 500 ft. (75 to 150 m) |
| Weight | 45 lbs./1000 ft.$^2$ (20.2 kg/100 m$^2$) |
| Diamond Dimension | 3" LWD × 1⅓" SWD (7.6 cm LWD × 3.3 cm SWD) |
| Resistance Lengthwise (4 ft., 122 cm wide) | .014 ohm/ft. |
| Resistance Widthwise with Current Distributor | .005 ohm/ft. (0.016 ohm/m) |
| Bending Radius | 3/32 inches (0.24 cm) |
| Bending Radius in Mesh Plane | 50 ft. (15 m) |

These meshes are coated typically with a mixed metal oxide catalytic coating providing good oxygen specificity at a maximum recommended anode-concrete interface current density (i.e. the current density on the strands of the mesh) of 10 mA/ft$^2$ (about 100 mA/m$^2$). The precious metal loading of the catalyst is between about 0.05 and 0.5 g/m$^2$ of the mesh. The same thin catalytic coating is applied to current distributors typically made from strips of the same titanium having a width of about 0–5 inch (1.25 cm), and a thickness of about 0.04 inch (0.1 cm).

INSTALLATION PROCEDURE

Application of the coated mesh for corrosion protection such as to a concrete deck or substructure can be simplistic. A roll of the greatly expanded valve metal mesh with a suitable electrochemically active coating, sometimes referred to hereinafter simply as the "anode", can be unrolled onto the surface of such deck or substructure. Thereafter, means of fixing mesh to substructure can be any of those useful for binding a metal mesh to concrete that will not deleteriously disrupt the anodic nature of the mesh. Usually, non-conductive retaining members will be useful. Such retaining members for economy are advantageously plastic and in a form such as pegs or studs. For example, plastics such as polyvinyl halides or polyolefins can be useful. These plastic retaining members can be inserted into holes drilled into the concrete. Such retainers may have an enlarged head engaging a strand of the mesh under the head to hold the anode in place, or the retainers may be partially slotted to grip a strand of the mesh located directly over the hole drilled into the concrete.

Usually when the anode is in place and while held in close contact with the concrete substructure by means of the retainers, an ionically conductive overlay will be employed to completely cover the anode structure. Such overlay may further enhance firm contact between the anode and the concrete substructure. Serviceable ionically conductive overlays include portland cement and polymer-modified concrete.

In typical operation, the anode can be overlaid with from about 2 to about 6 centimeters of a portland cement or a latex modified concrete. In the case where a thin overlay is particularly desirable, the anode may be generally covered by from about 0.5 to about 2 centimeters of polymer modified concrete. The expanded valve metal mesh substrate of the anode provides the additional advantage of acting as a metal reinforcing means, thereby improving the mechanical properties and useful life of the overlay. It is contemplated that the metal mesh anode structure will be used with any such materials and in any such techniques as are well known in the art of repairing underlying concrete structures such as bridge decks and support columns and the like.

Figure 4:
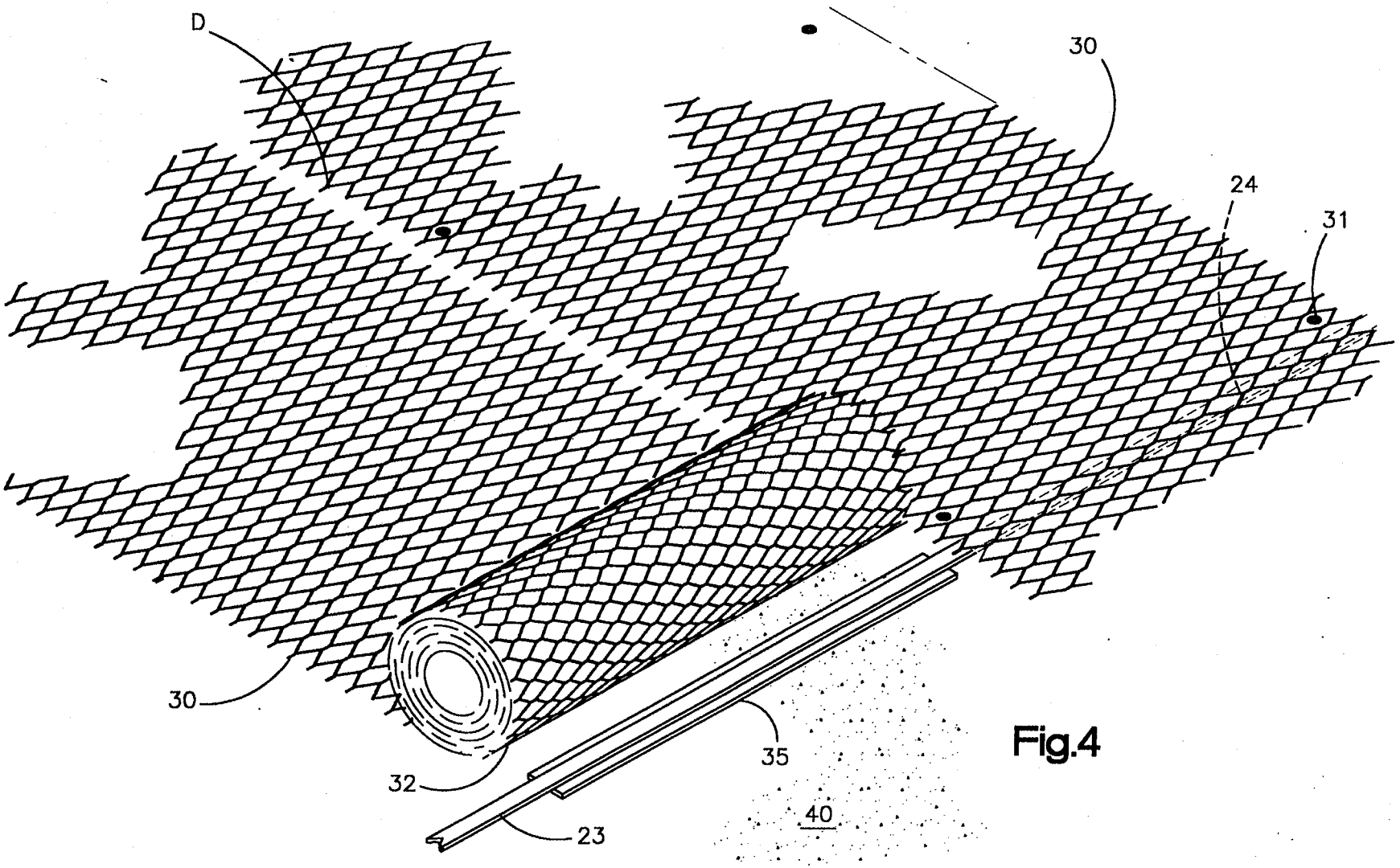
FIG. 4 is a perspective view illustrating the installation procedure on a steel-reinforced concrete deck.

FIG. 4 illustrates the installation of a mesh of highly expanded titanium as specified above on a steel-reinforced concrete deck designated generally by 40. Before proceeding, the steel reinforcement of the deck is tested for its degree of corrosion and its suitability for preservation by cathodic protection, using known techniques including suitable potential measurements.

Prior to laying the rolls 32 of mesh, catalytically coated titanium current distributor strips 23 are laid across the deck 40 with a suitable spacing. In installations with the type 1 mesh, the current distributors 23 are typically spaced lengthwise by about 60 feet (18 meters). For the type 2 mesh, this spacing is about 100 feet (30 meters). At given locations, not shown, the strips 32 extend through holes in the deck 40 for connection to a current supply; for the type 1 mesh the spacing of these power feed locations is about 24 feet (7.2 meters) widthwise of the meshes. For the type 2 mesh this widthwise spacing is about 32 feet (9.8 meters).

FIG. 4 shows a first anode mesh 30 which has already been laid by unrolling from its roll, stretched longitudinally by about 5–10% and fixed to the deck 40 by inserting plastic clips 31 in holes drilled in the deck. After this fixing, the mesh 30 is spot welded to the transverse current distributor strips 23 at nodes 25 of the mesh (as shown in FIG. 2). For this welding operation, a copper bar 35 is inserted under the mesh 30 and strip 23; this enables a sufficient welding current to be passed through the weld. After welding all or a selected number of the nodes across the width of the mesh 30 to the strip 23, the bar 35 is withdrawn from under the mesh and placed under the strip 23 in position to receive the next roll of mesh 30, as shown in FIG. 3.

As illustrated, the adjacent unrolled sheets of mesh 30 are spaced by a distance D. Clear spacings of up to about 1 LWD dimension are possible while producing an even cathodic protection effect on the underlying steel. Alternatively the edges could overlap, e.g. by about 1 LWD of the mesh or more, if necessary to conform to the width of the deck 40.

After laying all rolls of the mesh in this way, and fitting any odd shapes at corners, edges, etc., the deck 40 with mesh 30 is embedded in a thin layer of cement based grout. Then an non-conductive layer of about 4–6 cm portland cement or polymer modified concrete is applied, by pouring or spraying.

It is to be noted that during installation, i.e., after laying and fixing the mesh 30 it is possible to work on the surface, drive vehicles over it etc. with little or no risk of damaging the mesh and further with the assurance that any accidental breakage of several strands will not adversely affect the cathodic protection effect, due to the enhanced redundancy of the mesh.

We claim:

1. A cathodically-protected steel-reinforced concrete structure comprising an impressed-current anode embedded in an ion-conductive overlay of the concrete structure, wherein the anode comprises at least one sheet of expanded valve metal mesh having a pattern of voids defined by a network of valve metal strands, the strands of the expanded valve metal mesh being interconnected at a multiplicity of nodes in an uninterrupted continuum of strands and nodes providing redundancy of current carrying paths through the mesh which ensures effective current distribution through the mesh even in the event of possible breakage of a number of individual strands, said expanded valve metal mesh having a void fraction of at least 92%, and said strands having a thickness of less than 0.125 cm., whereby the anode provides a surface area such that acid generated by anodic reaction will not be detrimental to surrounding concrete, the surface of the valve metal mesh carrying-an electrochemically active coating, said at least one sheet of expanded valve metal mesh extending essentially continuously over and coextensive with the entire area of the structure to be protected with no discontinuity larger in two mutual perpendicular directions than twice the largest dimension of the voids of the mesh, and the anode further comprising at least one current distribution member for supplying current to the strands and nodes of the valve metal mesh, the current distributor being a metal member extending across the mesh.

2. The structure of claim 1, wherein the expanded mesh consists of a sheet of expanded valve metal expanded by a factor of at least 15 to 30 times to provide a pattern of substantially diamond-shaped voids and a continuous network of valve metal strands interconnected by between about 500 to 2000 nodes per square meter of the mesh.

3. The structure of claim 1, wherein said at least one current distribution member is a strip of valve metal metallurgically bonded to the mesh.

4. The structure of claim 3, wherein a plurality of current distributor strips are bonded to the mesh with a spacing of between about 10 and 50 meters.

5. The structure of claim 3, wherein the current distributor strips are spot welded to nodes of the mesh.

6. The structure of claim 1, wherein at least one sheet of mesh has a cut-out section bounding an obstacle on the structure.

7. The structure of claim 1, wherein the ion-conductive overlay comprises Portland cement concrete or polymer modified concrete.

8. The structure of claim 1, further comprising a current supply connected to the current distribution member to supply a cathodic protection current at a current density up to about 100 $mA/m^2$ of the strand surface area.

9. The structure of claim 8, which is a concrete deck covered by a series of side-by-side elongate sheets of mesh with a common current distributor strip extending across the sheets, said current distributor strip extending through an aperture in the deck to a current supply disposed underneath the deck.

10. The structure of claim 1, which is a concrete pillar encased with the mesh and ion-conductive overlay.

11. The structure of claim 1, which is a bridge deck, parking garage deck, or pier having at least one sheet of valve metal mesh extending continuously in one direction over a length of at least 10 meters.

12. A cathodically-protected steel-reinforced concrete structure comprising an impressed-current anode embedded in an ion-conductive overlay of the concrete structure, wherein the anode comprises at least one sheet of expanded titanium mesh consisting of one or more of titanium metal, its alloys or intermetallic mixtures, said expanded titanium mesh having a pattern of voids defined by a network of strands, the strands of the expanded titanium mesh being interconnected at a multiplicity of nodes in an uninterrupted continuum of strands and nodes providing redundancy of current carrying paths through the mesh which ensures effective current distribution through the mesh even in the event of possible breakage of a number of individual strands, said expanded titanium mesh having a void fraction of at least 92%, said strands having a thickness of less than 0.125 cm., with the weight of the titanium mesh being within the range of from about 0.05 to about 0.5 kilogram of metal per square meter of said titanium mesh, whereby the anode provides a surface area such that acid generated by anodic reaction will not be detrimental to surrounding concrete, the surface of the titanium mesh carrying an electrochemically active coating, and the anode further comprising at least one current distribution member for supplying current to the strands and nodes of the titanium mesh, the current distributor being a metal member extending across the mesh.

13. The structure of claim 12, wherein the expanded mesh consists of a sheet of expanded titanium metal expanded by a factor of at least 15 to 30 times to provide a pattern of substantially diamond-shaped voids and a continuous network of titanium strands interconnected by between about 500 to 2000 nodes per square meter of the mesh.

14. The structure of claim 12, wherein the current distributor is a strip comprising titanium metal.

15. A method of cathodically protecting the structure of claim 1 or 12, comprising supplying a continuous or intermittent current to the mesh anode at a current density effective for oxygen generation on the surfaces of the coated mesh.

* * * * *